US005501064A

United States Patent [19]

Ingram et al.

[11] Patent Number: 5,501,064

[45] Date of Patent: Mar. 26, 1996

[54] APPARATUS AND METHOD FOR PUSHING ARTICLES INTO RECEPTACLE

[75] Inventors: Steve Ingram, Woodstock; Frank Moncrief, Acworth, both of Ga.; Charles McNamara, Tucson, Ariz.

[73] Assignee: Riverwood International Corporation, Atlanta, Ga.

[21] Appl. No.: 330,496

[22] Filed: Oct. 28, 1994

[51] Int. Cl.[6] ..... B65B 21/08; B65B 35/40; B65B 35/44; B65B 39/14

[52] U.S. Cl. ..... 53/473; 53/48.1; 53/252; 53/543; 53/566

[58] Field of Search ..... 53/566, 564, 252, 53/251, 260, 473, 48.5, 48.1, 258, 259, 543

[56] References Cited

U.S. PATENT DOCUMENTS 3,269,091 8/1966 Martin ..... 53/566 X
3,453,800 7/1969 Mahncke ..... 53/566 X
4,250,693 2/1981 Andersson ..... 53/252 X
5,052,544 10/1991 Anderson ..... 53/252 X
5,072,573 12/1991 Tisma ..... 53/566 X

*Primary Examiner*—James F. Coan

[57] ABSTRACT

A beverage container packaging machine which employs a series of pusher plates to move groups of containers into open-ended carrier sleeves. The plates are pivotally attached to two continuous chains which are arranged so as to maintain the plates parallel to the downstream direction of travel of the containers and sleeves. The chains move the plates in a diagonal run toward the loading station wherein the downstream component of movement is at a speed similar to the speed of travel of the containers and sleeves, and the right angle component causes the plates to push the containers into the sleeves.

15 Claims, 4 Drawing Sheets

16
88
72
34
82
42
66
70
58
42
34
80
30
26
28
64
40
36
38
34
44
50
56
42
46
32
26
68
16
34
48
62
C
C
S
S
S
S

APPARATUS AND METHOD FOR PUSHING ARTICLES INTO RECEPTACLE

FIELD OF THE INVENTION

This invention relates to a machine for packaging articles in a carton. More particularly, it relates to a packaging machine that pushes articles into an open-ended carton sleeve through the open ends of the sleeve.

BACKGROUND OF THE INVENTION

Machines for packaging articles such as beverage cans and bottles into sleeve-type carriers or cartons are capable of moving carton sleeves in a downstream direction while at the same time inserting the articles through open ends of the sleeves, after which the end flaps of the carton are folded over to form the end panels. The articles are moved into the machine area by an infeed conveyor and are typically moved to the loading area by conveying means, such as a flight bar or a conveyor, after which they are guided into the sleeves by guide rails. While effective in introducing articles into a sleeve, this method is at times susceptible to jamming and does not normally have the capability of inserting the articles as swiftly as desired into the sleeve.

Another method of introducing articles into a carton makes use of a pusher plate assembly, in which a series of plates are moved at an angle toward the loading station at a speed whereby the downstream component of movement of the plates is the same as the speed at which the carton sleeve and the articles are moving. The component of movement of the plates which is at right angles to the downstream direction causes the plates to push the articles at the loading station into an adjacent carton sleeve. While this loading action enables articles to be more positively pushed into a carton, the mechanism for accomplishing it tends to create other problems. For example, in one design the path of movement of the pusher plates is controlled by cams, resulting in the mechanism being quite large and labor intensive to maintain. In another design the pusher plates are connected to an endless chain and tend to move out of parallel when making the turns between the upstream and downstream runs. This is not a desirable condition since the less smooth the movement of the plates and chain, the more stresses are introduced into the mechanism.

It would be very desirable to be able to positively push articles to be packaged into a carton sleeve without encountering the problems noted above.

BRIEF SUMMARY OF THE INVENTION

In accordance with the invention, a packaging machine for loading articles into a receptacle is provided which comprises means for moving a group of a predetermined number of articles in a downstream direction, means for moving a receptacle adjacent the group of articles in the downstream direction at substantially the same speed as the articles, and an article pusher plate. The pusher plate is moved in a continuous closed path on the side of the article moving means remote from the receptacle moving means. The path includes a diagonal run having a component of movement in the downstream direction and a transverse component of movement toward the receptacle moving means to enable the plate to contact and push the articles toward the moving receptacle. The plate moving means also includes means for maintaining the plate substantially parallel to the downstream direction at all times.

Preferably, the means for maintaining the plate substantially parallel to the downstream direction comprises a first continuous chain pivotally connected to the plate at one location and a second continuous chain pivotally connected to the plate at a different location, each chain traveling in a closed path. The path of travel of one of the chains is similar to but horizontally offset from the path of travel of the other chain. In a preferred arrangement, each chain is trained about a plurality of sprocket wheels, the centers of radius of the sprocket wheels of one chain being horizontally offset from the centers of radius of associated sprocket wheels of the other chain such that a vertical plane extending through the center of radius of a sprocket wheel in one chain and the center of radius of an associated sprocket wheel in the other chain is substantially parallel to the diagonal run of the plate. The chains preferably are connected to the plate by support arms extending from the plate and preferably are vertically spaced from each other.

The invention provides a positive means for pushing articles into an adjacent carton sleeve or other receptacle while minimizing the stresses generated by the pushing equipment as a result of maintaining the pusher plates parallel to the direction of flow of the articles. The apparatus is economical to provide and is simple to maintain.

The features of the invention which enable it to provide these desirable results are brought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
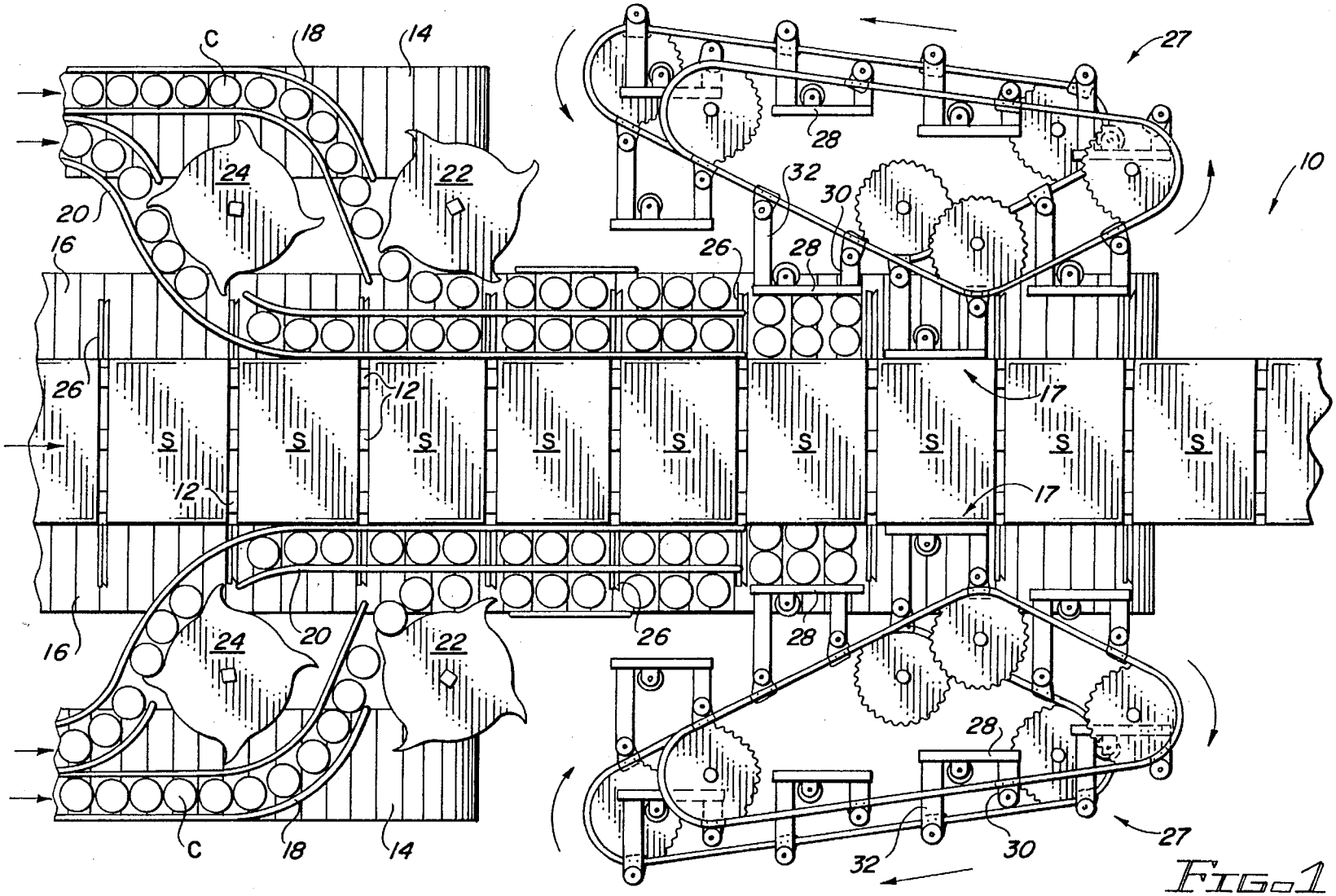
FIG. 1 is a simplified plan view of a packaging machine which includes the article pusher plate section of the invention, wherein certain elements of the drive mechanism have been omitted for the sake of clarity.

Referring to FIG. 1, carton sleeves S are pushed downstream along a central path of packaging machine 10 by lugs 12 mounted on endless chains, not shown, located beneath the upper surface of the machine. At the upstream end on either side of the carton sleeve moving means are infeed conveyors 14 which transport beverage containers C or other articles to be packaged in a downstream direction. Between the infeed conveyors 14 and the carton sleeve moving means are accelerator conveyors 16 which receive the containers from the infeed conveyors and move them downstream toward a loading station 17. The containers are shown as being guided to the conveyors 16 by the curved guide rails 18 and 20 and being segregated into groups of three by metering wheels 22 and 24. By this means, two groups of three containers are fed to the accelerator conveyor 16 between each pair of spaced conveyor lugs 26, with the result that successive groupings of six containers are moved toward the loading station 17.

The structure described thus far is typical of packaging machines and may be modified as desired. For example, any desired means for feeding and metering articles and for moving the carton sleeves other than the means illustrated may be employed. It will be understood, however, that the speed at which the articles C are moved should be the same as the speed at which the carton sleeves S are traveling, and the sleeves and article groupings should be aligned so as to allow the groups of articles to be pushed into the open ends of the sleeves at the loading station. These parameters are well known in the art and the ability to achieve them is well within the scope of one skilled in the art, thus requiring no further explanation of details at this time.

Still referring to FIG. 1, a pusher plate mechanism 27 located adjacent the loading station 17 is comprised of a number of pusher plates 28 connected by support arms 30 and 32 to moving chains, not shown in this view for the sake of clarity. As illustrated, the pusher plates 28 are maintained parallel to the downstream direction of flow of the carton sleeves and articles at all times, even during the turns in their closed path. The path of travel of the pusher plates is diagonally toward the moving carton sleeves so that each plate moves both downstream and inwardly toward the sleeves as it approaches the loading station. The downstream component of travel is at the same speed as the speed of the articles C and the sleeves S, and the timing of the movement of the plates in their closed path maintains the plates aligned with an associated moving group of articles and an associated carton sleeve. The inward component of movement of the plates, which is at right angles to the downstream direction, reaches its most inward point at the loading station, resulting in the adjacent group of articles being pushed by the plate through the open end of the adjacent carton sleeve. Although two pusher plate mechanisms are shown in order to load a carton sleeve from both ends, obviously a sleeve can be loaded from just one end if desired by either not running the feed conveyor and pusher plate mechanism on one side of the machine or simply by not supplying such equipment in the first place.

Figure 2:
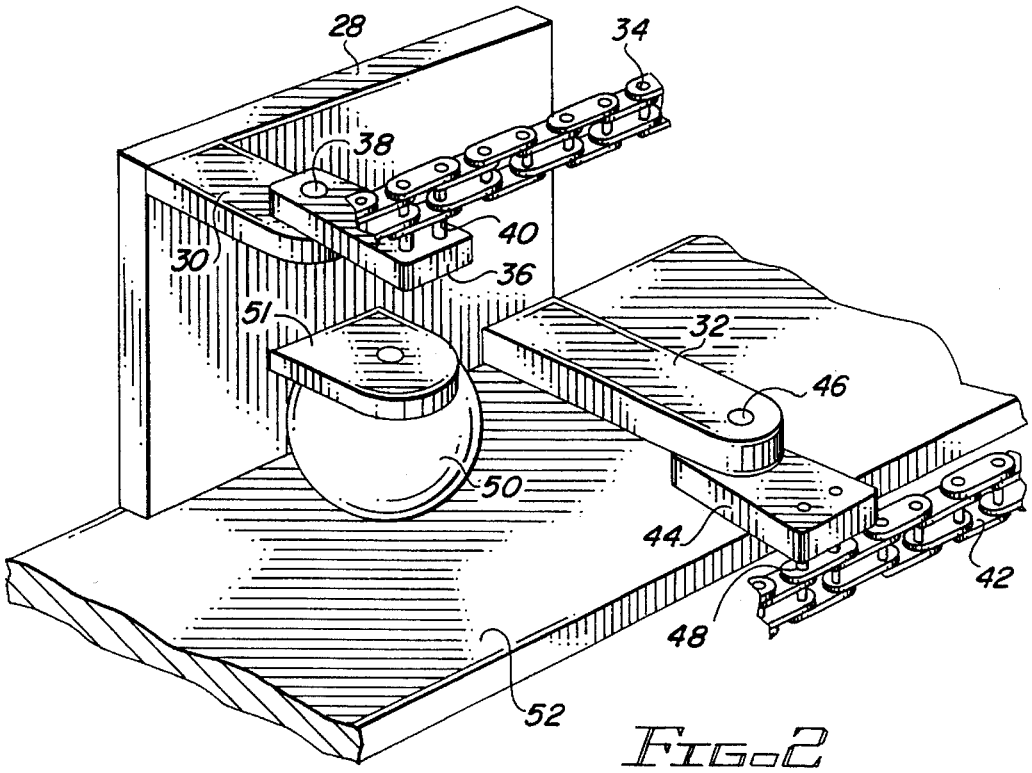
FIG. 2 is a pictorial view of the pusher plate of the invention, illustrating its connection to the drive chains.

Referring to FIG. 2, which shows the construction of a pusher plate in more detail, the support arm 30 is relatively short and is connected to the plate adjacent the leading upper corner while the support arm 32 is relatively long and is connected to the plate adjacent the trailing lower corner. The support arms may be attached to the plate by any suitable means, such as by screws or brackets, not shown. The arm 30 is connected to an upper continuous chain 34 by a link 36 which is connected to the arm by pivot pin 38 and to the chain by pins 40 that fit into complementary openings in the links of the chain. The arm 32 is similarly connected to a lower continuous chain 42 by link 44, pivot pin 46 and chain fastening pins 48. A caster 50 is also attached to an intermediate area of the plate 28 by bracket 51 so as to contact the machine surface 52, thereby assisting to support the plate and reduce stresses on the plate carrying mechanism.

Figure 5:
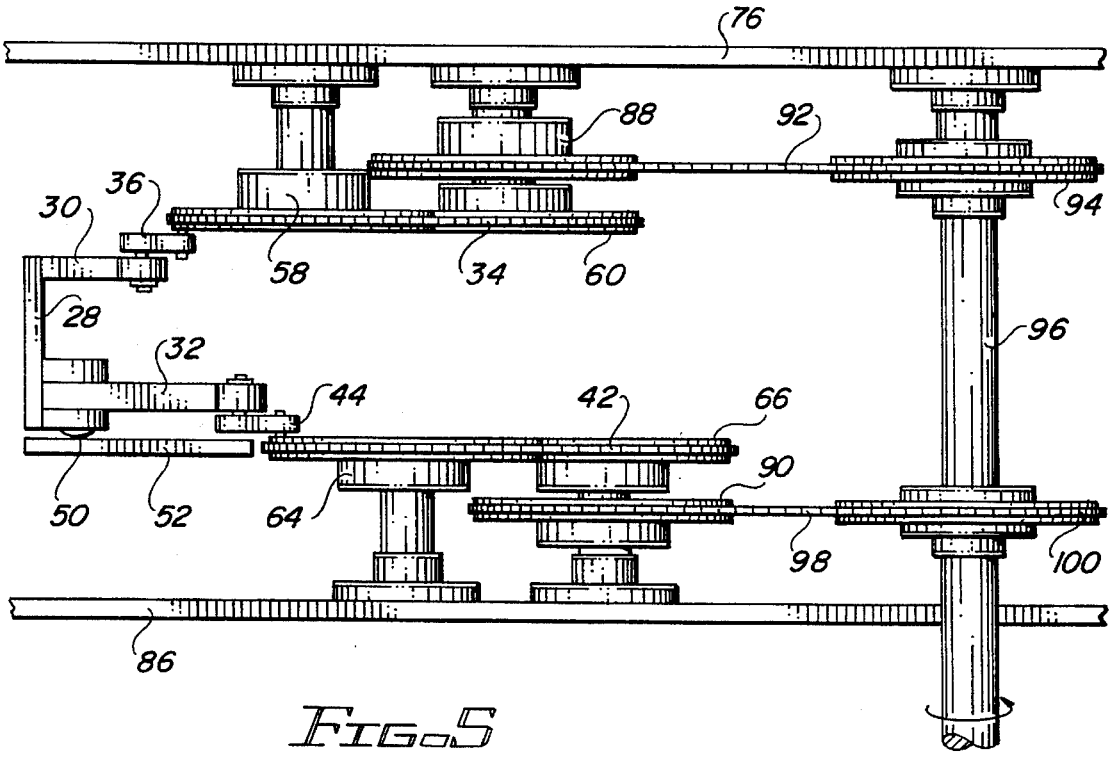
FIG. 5 is an end elevation of the drive mechanism of FIG. 3.
Figure 3:
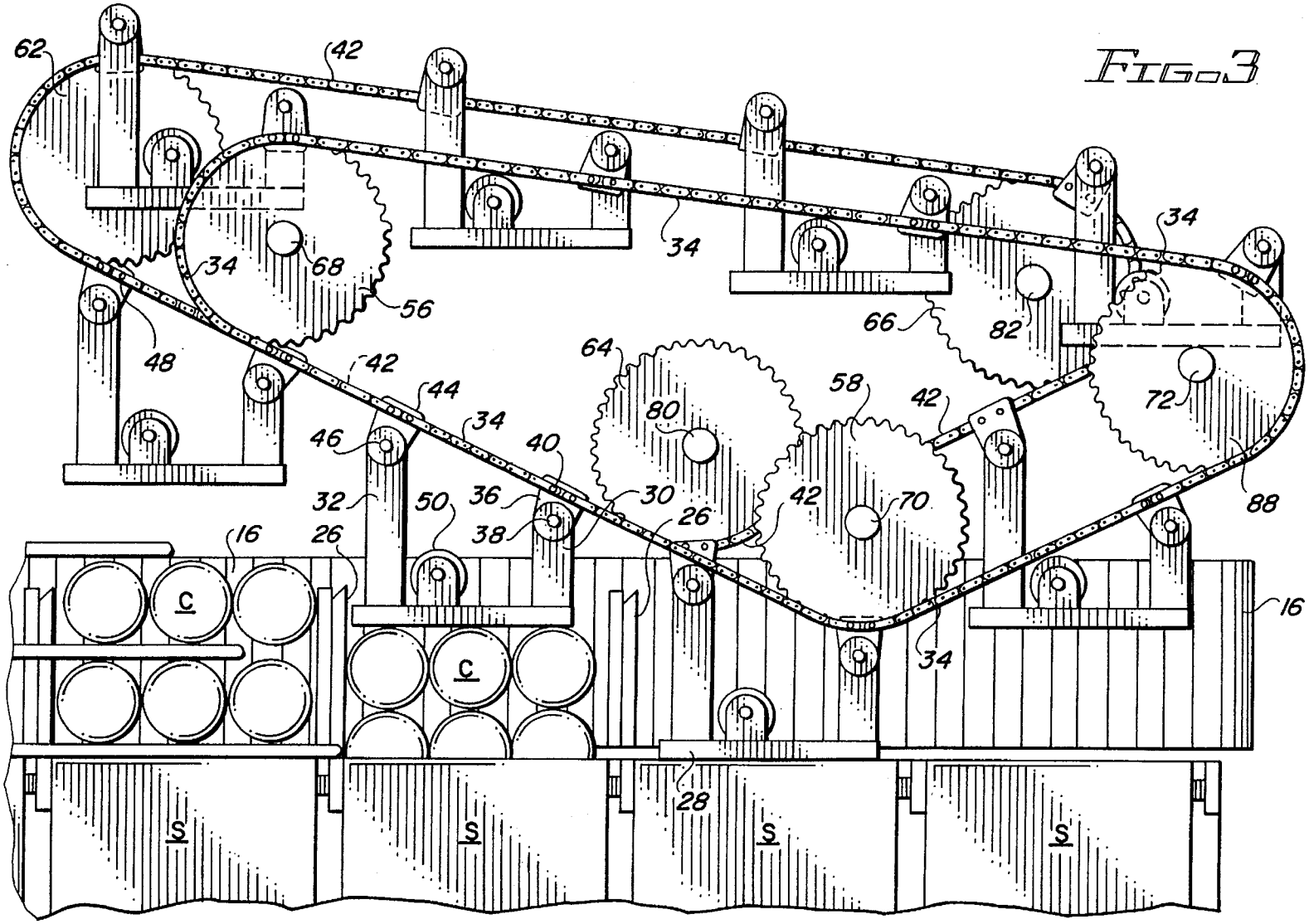
FIG. 3 is an enlarged plan view of the pusher plate section of the invention, including portions of the drive elements omitted from FIG. 1.
Figure 4:
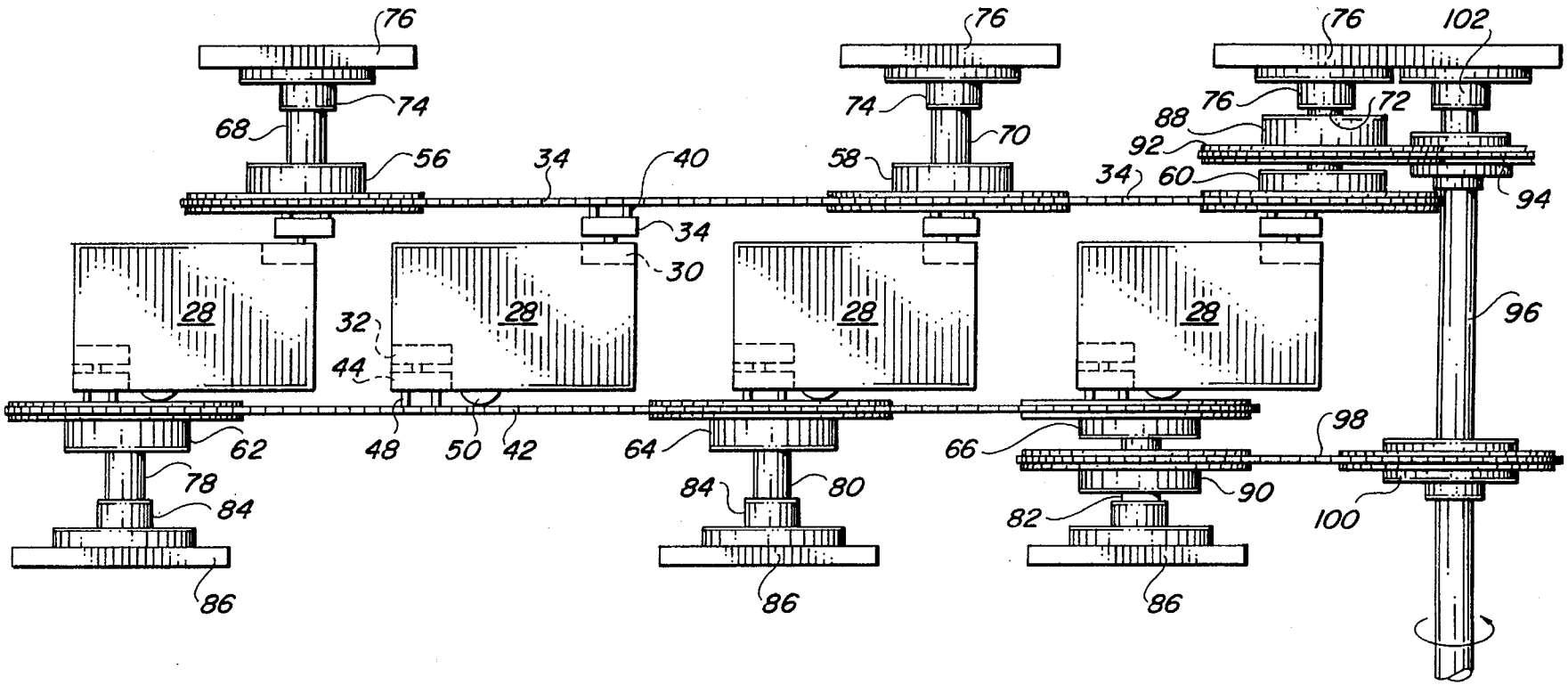
FIG. 4 is a side elevation of the drive mechanism of FIG. 3.

Referring now to FIGS. 3, 4 and 5, it can be seen that the upper chain 34 is trained about three sprocket wheels 56, 58 and 60 of similar diameter, and that the lower chain 42 is trained about three sprocket wheels 62, 64 and 66 of the same diameter as the first three sprocket wheels. The upper sprocket wheels are secured to shafts 68, 70 and 72, respectively, which are rotatably mounted in journals 74 attached to support structure 76. In similar fashion, the lower sprocket wheels 62, 64 and 66 are secured to shafts 78, 80 and 82, respectively, which are rotatably mounted in journals 84 attached to support structure 86. An additional sprocket wheel 88 is secured to the shaft 72 above the sprocket wheel 60, and another additional sprocket wheel 90 is secured to the shaft 82 beneath the sprocket wheel 66. A drive chain 92 is trained about the sprocket wheel 88 and about sprocket wheel 94, which is mounted on a vertical drive shaft 96. Another drive chain 98 is trained about the sprocket wheel 90 and about sprocket wheel 100, which is also mounted on the drive shaft 96. The upper end of the drive shaft is mounted in a journal 102 attached to the support structure 76, while the bottom portion is connected to a drive source, not shown. Rotation of the drive shaft 96 causes rotation of the sprocket wheels 88 and 90, which in turn cause rotation of the sprocket wheels 60 and 66 and movement of the chains 34 and 42.

As best shown in FIG. 3, the path of the chain 34 is offset from the path of the chain 42 in a direction and by an amount determined by the dimensions of the pusher plate and its support arms. The upper sprocket wheels 56, 58 and 60 are offset in a downstream direction from the corresponding lower sprocket wheels 62, 64 and 66 by an amount equal to the downstream distance between the pivot point 38 of the arm 30 and the pivot point 46 of the arm 32. The same sprocket wheels are offset from their counterparts in a direction at right angles to the downstream direction by a distance equal to the distance that the pivot points 38 and 46 are spaced apart in this direction. In accordance with this arrangement, a vertical plane passing through the centers of radius of the sprocket wheels in the downstream run of the chains is parallel with the downstream run of the chains.

Also as best shown in FIG. 3, it can be seen that the distance that the pusher plate 28 is spaced from the chains 34 and 42 varies with the location of the plate in its path of travel. It is spaced the greatest distance from the chains when the plate is closest to the path of travel of the articles to be packaged. This occurs when the pivot point 38 of the upper support arm 30 lies in a vertical plane extending through the center of radius of the sprocket wheel 58, and the pivot point 46 of the lower support arm 32 lies in a vertical plane extending through the center of radius of the sprocket wheel 64. The pusher plate is closest to the chains when the plate is farthest from the path of travel of the articles, which occurs when the pivot points 38 and 46 lie in vertical planes extending through the centers of radius of the sprocket wheels 56 and 62, respectively.

Since the chains travel about the periphery of the sprocket wheels 56 and 62 less than 180°, the links 36 and 44 are at an angle to their support arms 30 and 32 during the long diagonal leg of the downstream run. When the links 36 and 44 reach the point at which they are aligned with the support arms and the pusher plate is farthest from the chains, the pusher plate is at the loading station at the point closest in its movement toward an adjacent carton sleeve. The slight extra movement of the pusher plate due to the straightening of the links 36 and 44 provides added acceleration to the pushing movement of the plate as the plate pushes the articles into the adjacent sleeve.

The location of one support arm near the top of the pusher plate and the other near the bottom tends to give more uniform support to the plate than would be achieved by locating them intermediate the top and bottom. By supporting the plate from two separate chains the plate is maintained parallel to the direction of flow of the machine at all times, including turns of direction within the closed path of travel. The invention provides an efficient, easy to maintain pusher mechanism capable of positively pushing articles into an adjacent carton sleeve. The construction minimizes stresses and the size of the equipment. Because the invention is not necessarily limited to all the specific details described in connection with the preferred embodiment, except as they may be required by the appended claims, changes to certain features of the preferred embodiment which do not alter the overall basic function and concept of the invention are contemplated.

What is claimed is:

1. A packaging machine for loading articles into a receptacle, comprising:

means for moving a group of a predetermined number of articles in a downstream direction;

means for moving a receptacle adjacent said group of articles in said downstream direction and at substantially the same speed;

an article pusher plate; and means for moving the plate in a continuous closed path on the side of the article moving means remote from the receptacle moving means, the path including a diagonal run having a component of movement in said downstream direction and a component of movement at right angles thereto toward the receptacle moving means to enable the plate to contact and push the articles toward the moving receptacle;

the plate moving means including means for maintaining the plate substantially parallel to said downstream direction, said latter means comprising a first continuous chain connected to the plate at one location thereof and a second continuous chain connected to the plate at a different location, each chain traveling in a closed path.

2. The packaging machine of claim 1, including roller means connected to the plate, the roller means engaging a support surface to assist in supporting the plate.

3. The packaging machine of claim 1, wherein each chain is pivotally connected to the plate.

4. The packaging machine of claim 3, wherein the path of travel of one of the chains is similar to but horizontally offset from the path of travel of the other chain.

5. The packaging machine of claim 4, wherein each chain is trained about a plurality of sprocket wheels, the centers of radius of the sprocket wheels of one chain being horizontally offset from the centers of radius of associated sprocket wheels of the other chain such that a vertical plane extending through the center of radius of a sprocket wheel in one chain and the center of radius of an associated sprocket wheel in the other chain is substantially parallel to the diagonal run of the plate.

6. The packaging machine of claim 3, wherein the first chain is pivotally connected to a first support arm extending from the plate and the second chain is pivotally connected to a second support arm extending from the plate, the support arms extending from the side of the plate opposite from the article moving means.

7. The packaging machine of claim 6, wherein one of the support arms is longer than the other.

8. The packaging machine of claim 7, wherein a vertical plane through the pivotal connections of the first and second support arms is substantially parallel to the diagonal run of the plate.

9. The packaging machine of claim 6, wherein the first chain is vertically spaced from the second chain.

10. The packaging machine of claim 3, wherein each chain is driven by a drive sprocket wheel, each drive sprocket wheel being mounted on a common drive shaft.

11. A method for loading articles into a receptacle, comprising:

successively moving a plurality of groups of a predetermined number of articles in a downstream direction;

moving a plurality of receptacles adjacent the groups of articles in said downstream direction and at substantially the same speed;

moving a plurality of article pusher plates in a continuous closed path on the side of the articles remote from the receptacle, the path including a diagonal run having a component of movement in said downstream direction and a component of movement at right angles thereto toward the receptacles to enable successive plates to contact and push successive groups of articles toward an associated moving receptacle; and maintaining the plates substantially parallel to said downstream direction by moving the plates by means of two continuous chains connected to each plate at two separate locations and causing each chain to travel in a closed path.

12. The method of claim 11, wherein each chain is pivotally connected to the plates and the path of travel of one of the chains is similar to but horizontally offset from the path of travel of the other chain.

13. The method of claim 12, wherein each chain is trained about a plurality of sprocket wheels, the centers of radius of the sprocket wheels of one chain being horizontally offset from the centers of radius of associated sprocket wheels of the other chain such that a vertical plane extending through the center of radius of a sprocket wheel in one chain and the center of radius of an associated sprocket wheel in the other chain is substantially parallel to the diagonal run of the plate.

14. The method of claim 12, wherein the one of the chains is pivotally connected to a first support arm extending from each plate and the other chain is pivotally connected to a second support arm extending from each plate, the support arms extending from the sides of the plates opposite from the moving articles, and wherein a vertical plane through the pivotal connections of the first and second support arms is substantially parallel to the diagonal run of the plates.

15. The method of claim 11, wherein the articles are beverage containers and the receptacles are open-ended carrier sleeves.

* * * * *